US005295516A

United States Patent [19]

Tanaka et al.

[11] Patent Number: 5,295,516

[45] Date of Patent: Mar. 22, 1994

[54] METHOD OF OPERATING A DIRECT WEAVING APPARATUS

[75] Inventors: Tadashi Tanaka, Ohtsu; Yasuhiro Inoue, Settsu; Hirohiko Iida, Kobe; Morio Sakurai, Fukui; Kazuro Tokuda, Nagaokakyo, all of Japan

[73] Assignee: Murata Kikai Kabushiki Kaisha, Kyoto, Japan

[21] Appl. No.: 909,618

[22] Filed: Jul. 7, 1992

[30] Foreign Application Priority Data

Jul. 8, 1991 [JP] Japan ..... 3-194748
Sep. 17, 1991 [JP] Japan ..... 3-267295

[51] Int. Cl.[5] ..... D03D 47/34

[52] U.S. Cl. ..... 139/452; 139/1 R; 139/450; 139/453; 139/435.2

[58] Field of Search ..... 139/435.1, 429, 450, 139/452, 453, 1 R, 435.2; 242/47.01

[56] References Cited

U.S. PATENT DOCUMENTS 3,885,599 5/1975 Mawdsley et al. ..... 139/453 X
4,256,148 3/1981 Scharling, II ..... 139/450
4,559,976 12/1985 Araki et al. ..... 139/452 X
4,921,019 5/1990 Kawabata et al. ..... 139/452
5,069,395 12/1991 Krumm ..... 139/452 X

FOREIGN PATENT DOCUMENTS 3714826 6/1988 Fed. Rep. of Germany ..... 139/452
3-040831 2/1991 Japan ..... 139/435.1

*Primary Examiner*—Andrew M. Falik
*Attorney, Agent, or Firm*—Spensley Horn Jubas & Lubitz

[57] ABSTRACT

A method of operating a direct weaving apparatus which may include a loop provided with picking nozzles and a weft yarn processing machine having a yarn processing unit for processing yarns, feed rollers and yarn storage drums. The start of the yarn storage drums may be controlled in connection with the start of the weft yarn processing machine. The respective operating speeds of the feed rollers of the weft yarn processing machine may be held constant and the yarn storage drums may be operated in synchronism with the corresponding feed rollers respectively at winding speeds slightly higher than the respective feed speeds of the corresponding feed rollers.

5 Claims, 10 Drawing Sheets

METHOD OF OPERATING A DIRECT WEAVING APPARATUS

BACKGROUND OF THE INVENTION

1. Field of the Invention

The present invention relates to a direct weaving apparatus comprising, in combination, a loom, and a weft yarn processing machine for processing yarns and for directly feeding processed weft yarns to the loom and, more particularly, to a method of operating a direct weaving apparatus provided with yarn storage drums.

2. Prior Art

An ordinary loom is not provided with any weft yarn processing machine and weft yarns are processed by weft yarn processing processes separate from a weaving process. Weft yarn processing processes process yarns to produce various weft yarns; for example, weft yarn processing processes twists filament yarns to produce nonstretch textured yarns (Taslan® yarns) or entangled yarns, dye yarns, false-twist yarns or double yarns. Yarn packages of the weft yarns thus processed are supplied to the loom. Since the yarn is difficult to be unwound from the yarn package thus produced by the weft yarn processing process separate from the weaving process, only limited kinds of processed yarns can be used as weft yarns on the loom. Furthermore, weft yarn packages produced by the weft yarn processing process separate from the weaving process require a winding operation for winding processed weft yarns in yarn packages and the transportation of weft yarn packages from the winding process to the weaving process. Such a method of supplying weft yarn packages to the weaving process is unable to deal with fabric production in a multiproduct small-lot short cycle production system. To deal with fabric production in a multiproduct small-lot short cycle production system, there has been proposed a direct weaving apparatus comprising, in combination, a loom and a weft yarn processing machine and capable of carrying out various weft yarn processing processes and of omitting operations for winding weft yarns in weft yarn packages and the transportation of weft yarn packages.

A weft yarn processing machine is installed beside a loom to feed a weft yarn. The weft yarn processed within the weft yarn processing machine is supplied to a jet nozzle of the loom. A gripper and the jet nozzle are controlled in synchronism with the operation of the loom. A length of the weft yarn is retained in a yarn retaining pipe while the gripper is closed. The gripper is opened and compressed air is supplied to the jet nozzle to insert the weft yarn retained in the yarn retaining pipe, by the jet nozzle.

The direct weaving apparatus retains the weft yarn Y in a free state in the yarn retaining pipe while the gripper is closed. Therefore, it is feared that a highly textured entangled yarn or a Taslan yarn is snarled in the yarn retaining pipe. Accordingly, it is preferable to use a known yarn storage drum instead of the yarn retaining pipe. However, it is feared that an incompletely textured weft yarn is fed after the start of the weft yarn processing machine until the mode of operation of the weft yarn processing machine reaches a steady state. Accordingly, defects will be formed in the fabric in the initial stage of weaving operation if the weft yarn processing machine and the loom are started simultaneously and hence the waste suction pipe is necessary.

There has not been proposed any method of starting a direct weaving apparatus provided with yarn storage drums, capable of timely removal of waste yarns.

OBJECT AND SUMMARY OF THE INVENTION

It is an object of the present invention to provide a method of operating a direct weaving apparatus provided with yarn storage drums, capable of feeding complete weft yarns to prevent forming defects in the fabric.

To achieve the object, the present invention provides a method of operating a direct weaving apparatus comprising, in combination, a loom, and a weft yarn processing machine having yarn storage drums, comprising controlling the start of the yarn storage drums in connection with the start of the weft yarn processing apparatus.

The weft yarn processing machine is started independently of the loom and the incompletely processed weft yarn is passed through the yarn storage drum to remove the same as a waste yarn until the mode of operation of the weft yarn processing machine reaches a steady state. After the mode of operation of the weft yarn processing machine has reached the steady state, the weft yarn is wound on the yarn storage drum for storage, and then the loom is started up.

DETAILED DESCRIPTION OF PREFERRED EMBODIMENT

Figure 8:
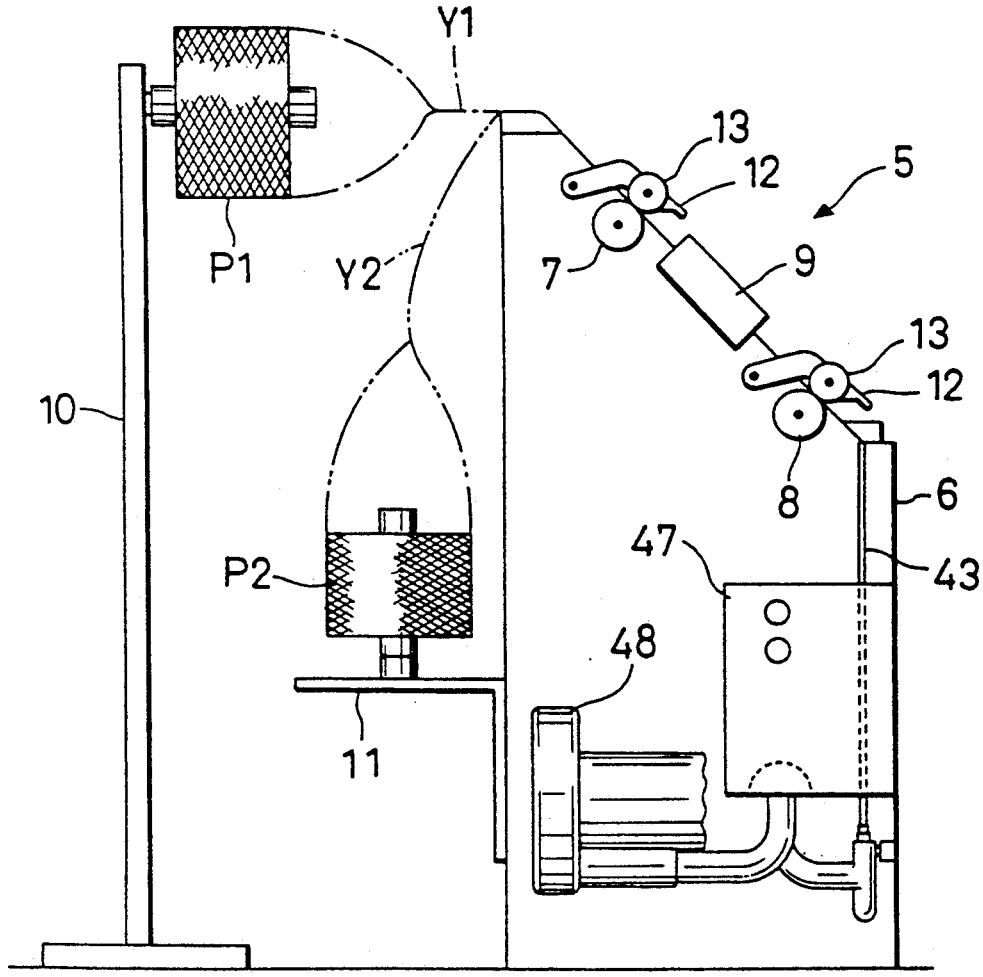
FIG. 8 is a sectional view taken on line X—X in FIG. 6.
Figure 6:
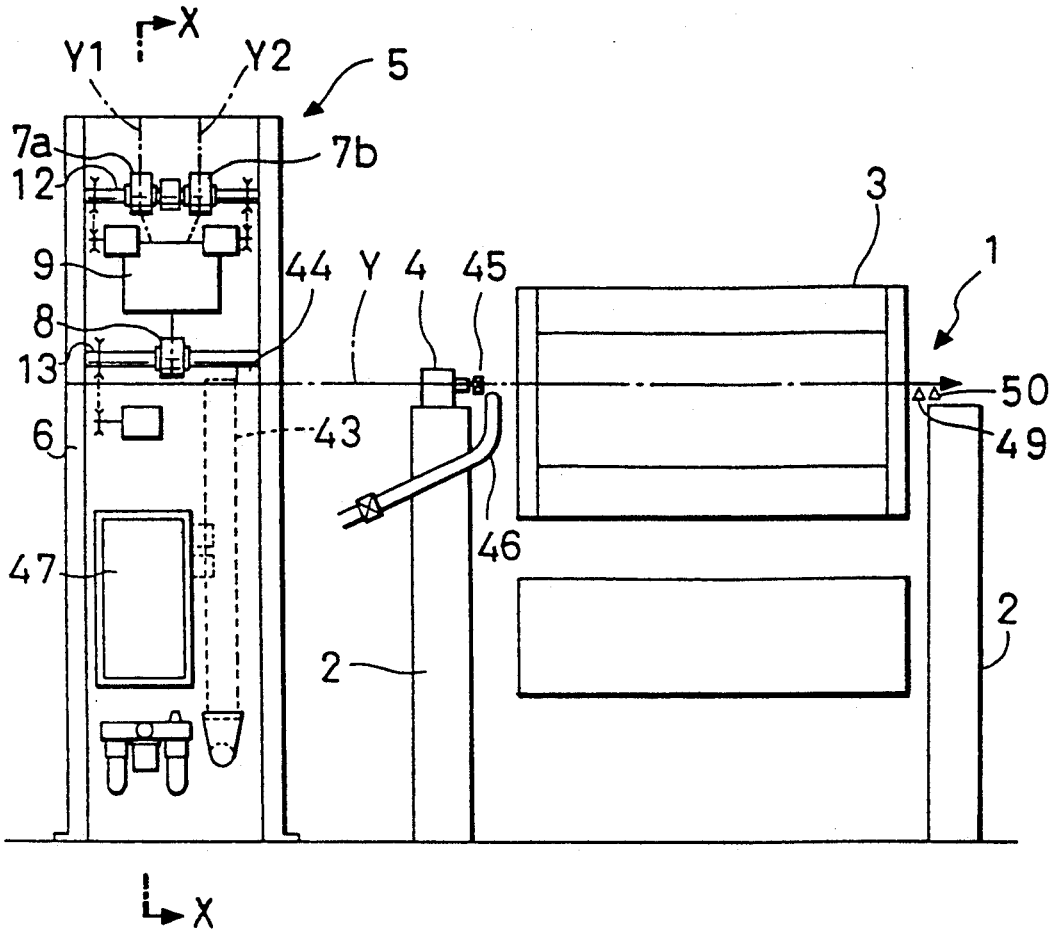
FIG. 6 is a side elevation of a direct weaving apparatus employing a yarn retaining pipe.
Figure 7:
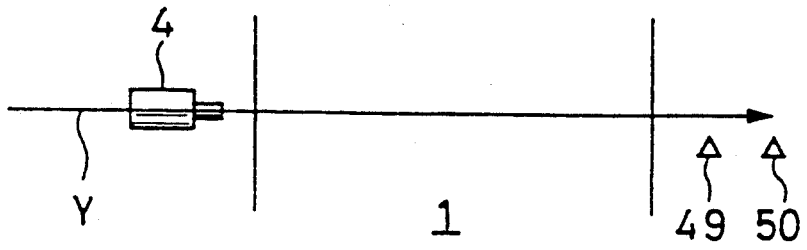
FIG. 7 is a schematic illustration showing a method for detecting a length of a weft yarn inserted into a loom.

Referring to FIGS. 6, 7 and 8, a direct weaving apparatus will be illustrated.

In FIG. 6, a plurality of heddle frames 3 are arranged for vertical movement between side frames 2 of a loom 1. A jet nozzle 4 for inserting a weft yarn Y into a shed of warp yarns formed by the heald frames 3 is supported on one of the side frames 2. A weft yarn processing machine 5 is installed beside the loom to feed the weft yarn Y. Disposed on one side of the loom 1 near the outlet end of the jet nozzle 4 are a cutting device 45 for cutting the weft yarn Y and a waste suction pipe 46 for sucking a waste weft in starting a weaving operation. A gripper 44, and a waste box 47 connected to a yarn retaining pipe 43 are provided on the housing 6 of the weft yarn processing machine 5.

The weft yarn processing machine 5 has a first feed unit having back rollers 7*a* and 7*b*, and a second feed unit having a front roller 8 disposed on the upper surface of the inclined upper wall of the housing 6. The second feed unit is disposed after the first feed unit with respect to the weft yarn feed direction. A processing unit 9 for processing the weft yarn is disposed between the rollers 7 and 8. The back rollers 7*a* and 7*b* are attached to the extremities of shafts 12 in a coaxial arrangement for individual rotation to feed two yarns Y1 and Y2, respectively. The shafts 12 are driven through pulleys and belts by motors M1 and M2, respectively. The front roller 8 for feeding a weft yarn Y to the jet nozzle 4 of the loom 1 is mounted on a shaft 13, which is driven through pulleys and a belt by a motor M3. As shown in FIG. 8, pressure rollers 13 supported on swing arms 12 engage the rollers 7 and 8 to nip the yarns Y1 and Y2 and the weft yarn, respectively. The processing unit 9 is capable of a texturing operation for selectively producing nonstretch textured yarns or entangled yarns. The processing unit 9 may be such as capable of a false-twisting operation or a doubling operation. The yarns Y1 and Y2, such as filament yarns, are fed to the processing unit 9 from two yarn packages P1 and P2 supported on stands 10 and 11 disposed behind the housing 6. A suction fan 48 is connected to the waste box 47 connected to the yarn retaining pipe 43. The operation of the direct weaving apparatus will be described hereinafter. Referring to FIG. 6, upon the start of the weft yarn processing machine 5, the back rollers 7*a* and 7*b* rotate to unwind the yarns Y1 and Y2 from the yarn packages and to feed the same to the processing unit 9, the processing unit 9 processes the yarns Y1 and Y2 to produce, for example, a nonstretch textured yarn and the front roller 8 delivers the nonstretch textured yarn to the jet nozzle 4 of the loom 1. The respective rotating speeds of the back rollers 7 and the front roller 8 are determined properly according to the weaving speed of the loom 1 and the type of the weft yarn Y to be produced by the processing unit 9. The gripper 44 and the jet nozzle 4 are controlled in synchronism with the operation of the loom 1. A length of the weft yarn Y is retained in the yarn retaining pipe 43 while the gripper is closed. The gripper 44 is opened and compressed air is supplied to the jet nozzle 4 to insert the weft yarn Y retained in the yarn retaining pipe 43, by the jet nozzle 4. The respective rotating speeds of the rollers 7 and 8 are determined so that the length of the weft yarn Y to be retained in the yarn retaining pipe 43 correspond to a length of the weft yarn Y to be inserted in one weaving cycle. Upon the completion of insertion of the weft yarn Y by the jet nozzle 4, the gripper 44 is closed and the cutting device 45 is actuated to cut the weft yarn Y. A two-position valve provided on the waste suction pipe 46 is open in a period between the start of the weft yarn processing machine 5 and time immediately before the start of the loom 1 to allow the weft yarns Y fed to the jet nozzles 4 to be sucked through the waste suction pipe 46 into the waste box 47. Upon the start of the loom 1, the two-position valve on the waste suction pipe 46 is closed, a predetermined length of the weft yarn Y retained in the yarn retaining pipe 43 is inserted into the shed of warp yarns in each weaving cycle to weave a fabric.

The direct weaving apparatus retains the weft yarn Y in a free state in the yarn retaining pipe 43 while the gripper 44 is closed. Therefore, there is fear that a highly textured entangled yarn or a Taslan yarn is snarled in the yarn accumulating pipe. Accordingly, it is preferable to use a known yarn storage drum instead of the yarn accumulating pipe. However, it is possible that an incompletely textured weft yarn is fed after the start of the weft yarn processing machine until the mode of operation of the weft yarn processing machine reaches a steady state. Accordingly, defects will be formed in the fabric in the initial stage of weaving operation if the weft yarn processing machine and the loom are started simultaneously and hence the waste suction pipe 46 is necessary.

Figure 1:
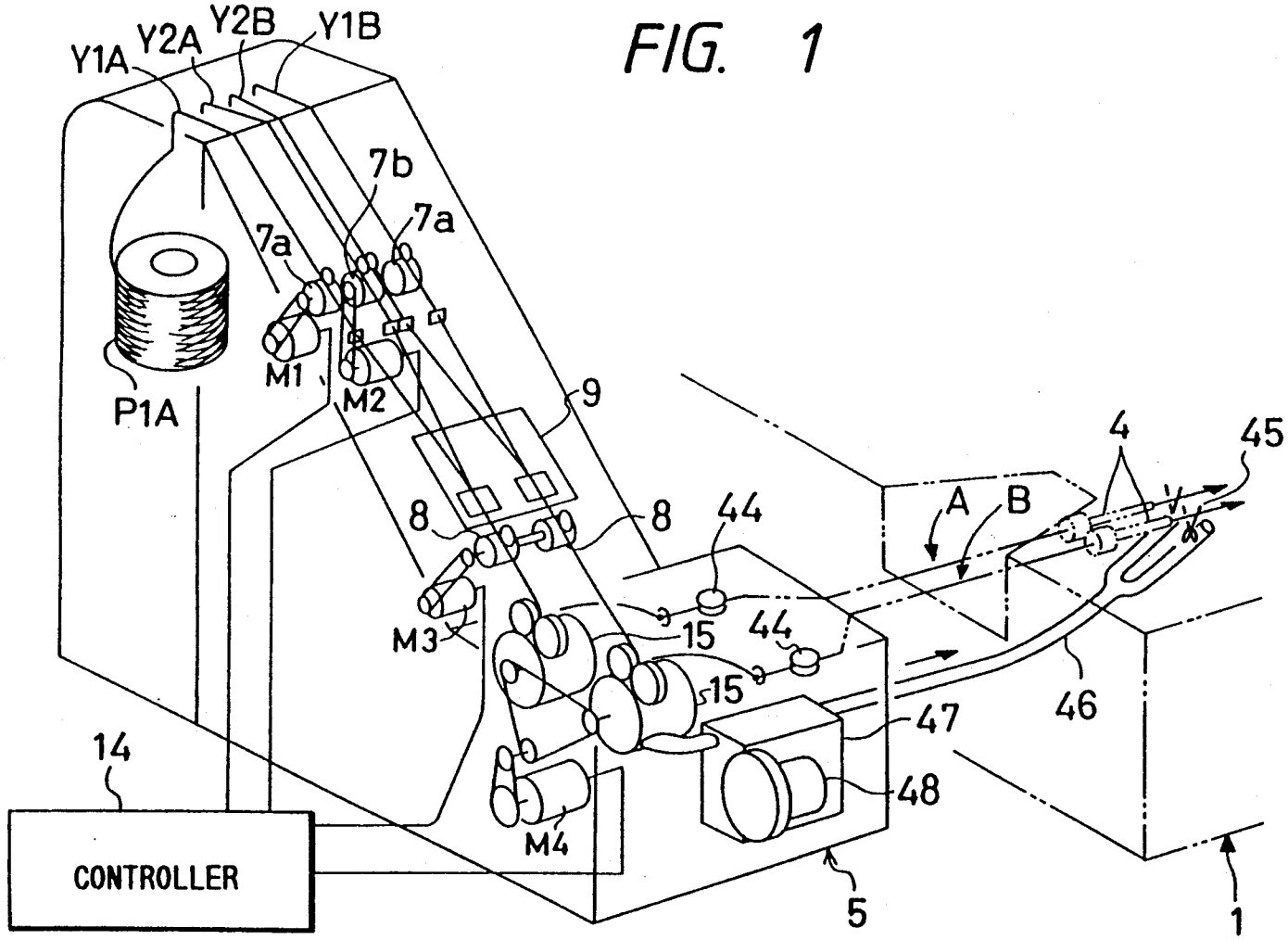
FIG. 1 is a perspective view of a direct weaving apparatus to which a method of the present invention is applied.

A method of starting a direct weaving apparatus, in a first preferred embodiment according to the present invention will be described hereinafter with reference to the accompanying drawings. First, a direct weaving apparatus to which the present invention is applied will be described with reference to FIGS. 1 to 3, in which parts like or corresponding to those of the prior art direct weaving apparatus shown in FIGS. 6, 7 and 8 are denoted by the same reference characters and the description thereof will be omitted. The direct weaving apparatus shown in FIG. 1 differs from that shown in FIGS. 6 and 7 in the employment of yarn storage drums instead of the yarn retaining pipe. As shown in FIG. 1, the direct weaving apparatus has two jet nozzles 4. The direct weaving apparatus is provided with two processing systems A and B, which process two yarns simultaneously.

Referring to FIG. 1 rotary yarn storage drums 15 are driven through belts and pulleys by a motor M4. A weft yarn processing machine controller 14 controls the respective operating speeds of motors M1 to M4.

Figure 2:
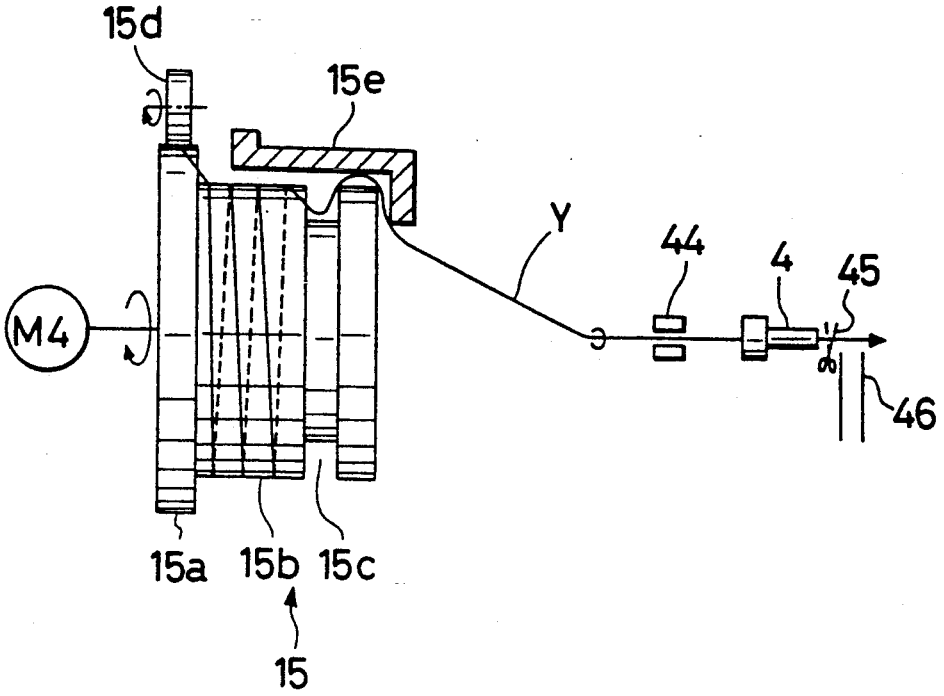
FIG. 2 is a side elevation of a yarn storage drum employed in the direct weaving apparatus of FIG. 1.

FIG. 2 is a side elevation of the rotary yarn storage drum 15. The yarn storage drum 15 is a rotary member having a flange 15*a*, a body 15*b* and a groove 15*c*. A pressure roller 15*d* is pressed against the circumference of the flange 15*a* to drive the yarn storage drum 15 for rotation in winding a weft yarn Y on the yarn storage drum 15 for storage. The weft yarn Y is retained in the groove 15*c* by an air current produced in a space between the circumference of the yarn storage drum 15 and a cover 15*e*. When a gripper 44 is opened, the weft yarn Y is unwound from the body 15*b* by the agency of air jetted through a jet nozzle. Since the weft yarn Y is wound on the body 15*b* for storage, the weft yarn Y is not entangled.

Figure 3:
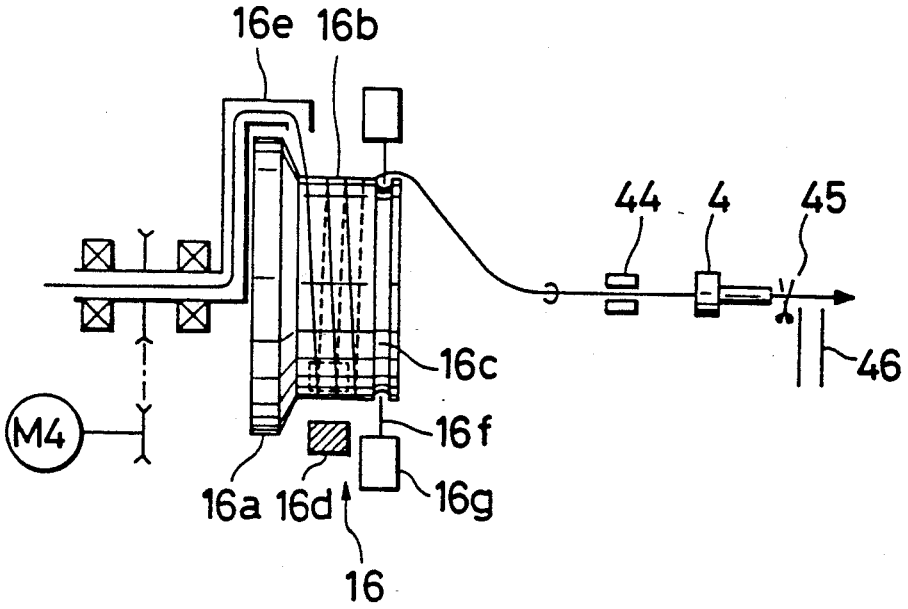
FIG. 3 is a side elevation of another yarn storage drum.

FIG. 3 is a side elevation of a yarn storage drum 16 of a revolving yarn guide type. The yarn storage drum 16 has a flange 16*a*, a body 16*b* and a groove 16*c* and is held stationary by a magnet 16*d*. A revolving yarn guide 16*e* formed by bending a pipe and driven by a motor M4 revolves around the flange 16*a* to wind the weft yarn Y around the body 16*b* for storage. The weft yarn Y is held in the groove 16*c* with a plurality of holding pins 16*f*. The holding pins are operated by solenoid actuators 16g. The length of the weft yarn Y to be unwound from the body 16b for one weaving cycle is regulated by varying the number of solenoid actuators 16g actuated simultaneously.

Figure 4:
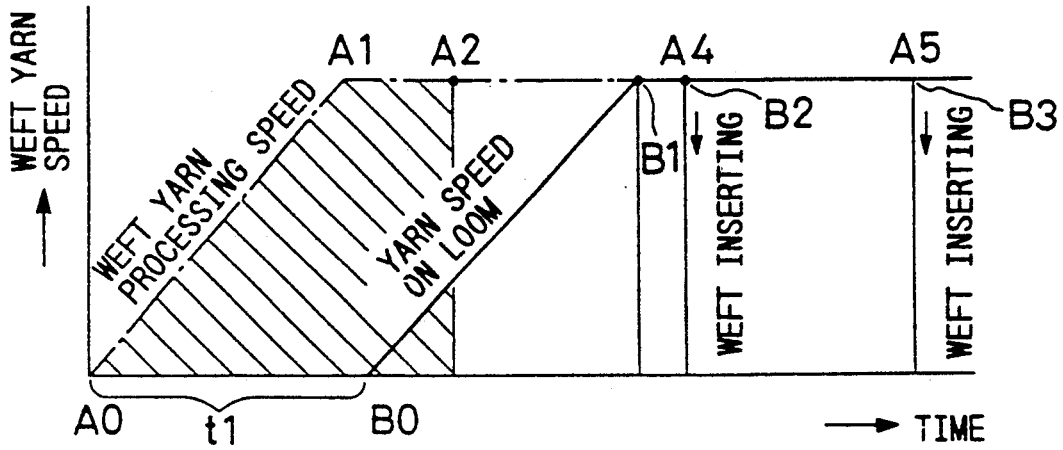
FIG. 4 is a timing chart of assistance in explaining a method of starting a direct weaving apparatus, in accordance with the present invention.

A method of starting the direct weaving apparatus thus constructed will be described hereinafter with reference to a timing chart shown in FIG. 4. In operating the direct weaving apparatus, first the weft yarn processing machine is started at time A0. Then, the operating speed of the weft yarn processing machine rises gradually and reaches a steady state at time A1. In a time interval between the time A1 and time A2 a predetermined time after the time A1, the grippers 44 (FIG. 2) are opened and air is jetted through the jet nozzles 4, so that the weft yarn Y are not wound on the bodies 15b and sucked into the waste suction pipe 46. A shaded area in FIG. 4 represents the quantity of weft yarns sucked into the waste suction pipe 46. At the time A2 (FIG. 4), the grippers are closed and, consequently, the weft yarns are wound on the yarn storage drums for storage. The area of a receptacle A2–A4 is the quantity of the weft wound on each yarn storage drum for the first weft inserting. On the other hand, the loop is started at time B0 with a delay of a t1 from the start of the weft yarn processing machine at the time A0, the operating speed of the loop increases gradually and reaches a steady state at time B1. The time t1 is determined so that time B2 a predetermined time after the time B1, coincides with the time A4 at which a necessary length of the weft yarn is stored on each yarn storage drum. The time t1 is timed by a timer after the start of the weft yarn processing machine and the loom is started upon the elapse of the time t1. Thus, completely textured weft yarns are fed successively from the start of the loom. When the yarn storage drum 16 of FIG. 3 is employed, all the holding pins 16f are retracted until the mode of operation of the weft yarn processing machine reaches the steady state to enable the waste suction pipe 46 to suck waste weft yarns. After the mode of operation of the weft yarn processing machine has reached the steady state, the holding pins 16f are brought into engagement with the yarn storage drum to start storing the weft yarn on the yarn storage drum.

Figure 5:
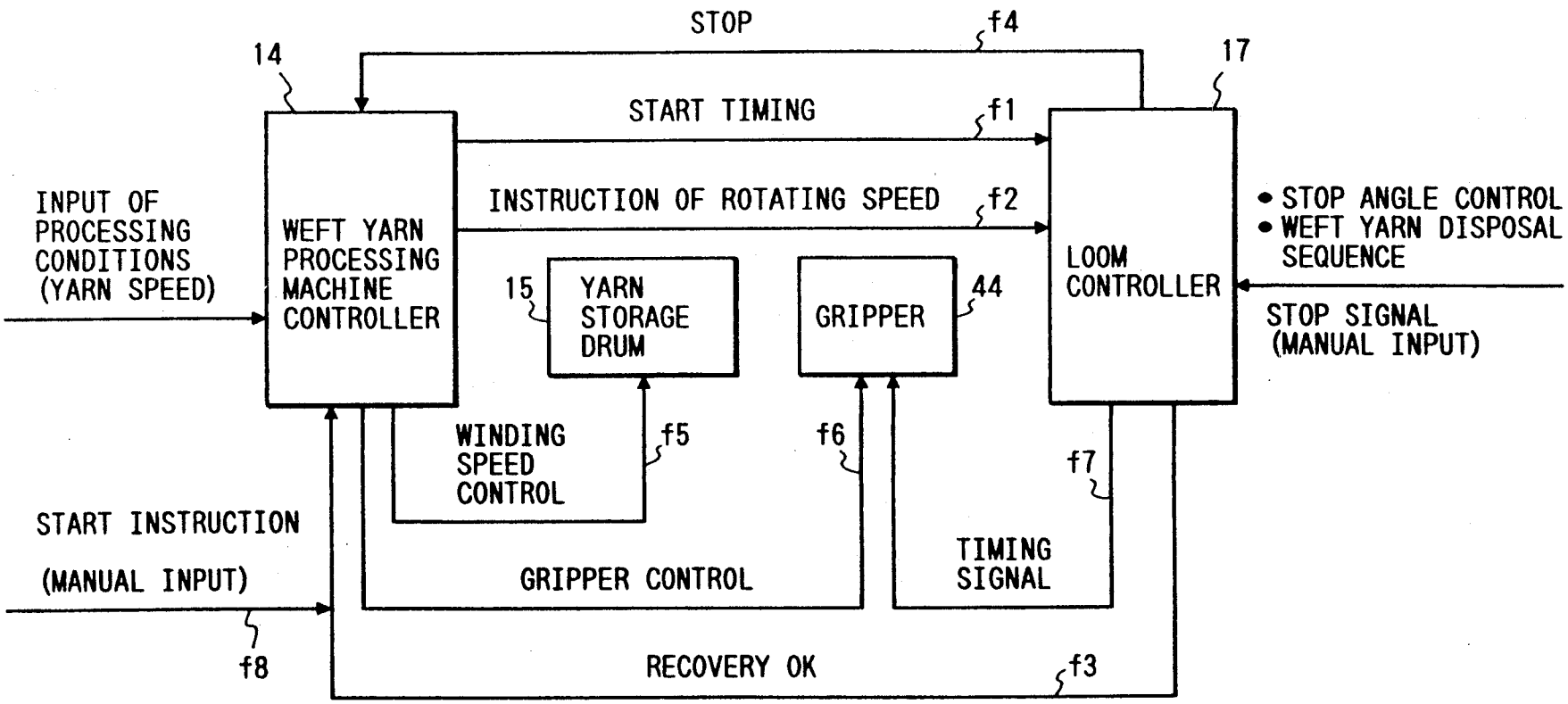
FIG. 5 is a block diagram of assistance in explaining a method of starting a direct weaving apparatus.

A control system for carrying out the method of starting the direct weaving apparatus will be described hereinafter with reference to FIG. 5. Referring to FIG. 5, there are shown a weft yarn processing machine controller 14, a loom controller 17, the yarn storage drum 15 and the gripper 44. Processing conditions including yarn speed are stored beforehand in the weft yarn processing machine controller 14. The loom controller 17 receives a start timing signal and a weaving speed signal through lines f1 and f2 from the weft yarn processing machine controller 14 and executes control operation on the basis of the received signals to determine a stopping angle and to carry out a waste yarn disposal sequence. The loom controller 17 sends a waste recovery signal through a line f3 to the weft yarn processing machine controller 14 to notify the weft yarn processing machine controller 14 that the loom is ready to start. The loom controller 17 gives an emergency stop signal through a line f4 to the weft yarn processing machine controller 14. The weft yarn processing machine controller 14 provides a winding speed control signal on a line f5 to control the rotating speed of the yarn storage drum and provides a gripper control signal on a line f6 to control the gripper for on-off operation. The loom controller provides a timing signal on a line f7 to time the operation of the gripper. The starting operation shown in FIG. 4 is carried out only by applying a starting signal through a line f8 to the weft yarn processing machine controller 14.

The method of operating the direct weaving apparatus, in accordance with the present invention is characterized in stating the yarn storage drum in connection with the start of the weft yarn processing machine; that is, the weft yarn incompletely processed during a start up period between the start of the weft yarn processing machine and time when the mode of operation of the weft yarn processing machine reaches a steady state is passed through the yarn storage drum to remove the incompletely processed weft yarn, the weft yarn is wound on the yarn storage drum for storage after the mode of operation of the weft yarn processing machine has reached the steady state, and then the loom is started up after a necessary length of the weft yarn has been stored on the yarn storage drum. Therefore, only the completely processed weft yarn is fed to the loom even if the direct weaving apparatus is provided with the yarn storage drum instead of the yarn retaining pipe to prevent forming defects in the fabric.

As shown in FIG. 7, the two yarn detectors 49 and 50 for detecting the leading end of the inserted weft yarn Y are disposed on one side of the loom 1 opposite the side of the same on which the jet nozzle 4 is disposed. The yarn detector 49 goes ON state (the weft yarn is detected) and the yarn detector 50 remains OFF state (the weft yarn is not detected) when a appropriate length of the weft yarn Y is inserted, both the yarn detectors 49 and 50 remain OFF state and the processing speed of the weft yarn processing machine 5 is increased at a predetermined rate if an insufficient length of the weft yarn Y is inserted, and both the yarn detectors 49 and 50 go ON state and the processing speed of the weft yarn processing machine 5 is reduced if an excessively long length of the weft yarn Y is inserted.

Thus, since the processing speed of the weft yarn processing machine varies according to the length of the inserted weft yarn, the winding speed of the yarn storage drum needs to be varied according to the variation of the operating speed of the feed roller. Furthermore, the weft yarn processing machine is unable to produce a uniform weft yarn when the winding speed of the yarn storage drum needs to be changed at a high rate, because of the difference in inertia between the feed roller and the yarn storage drum. So, a second embodiment of the present invention provides a method of operating a direct weaving apparatus employing a yarn storage drum, capable of controlling the direct weaving apparatus so as to supply a weft yarn of uniform quality.

A method of continuously operating a direct weaving apparatus of the second embodiment comprising in combination, a loom provided with jet nozzles, and a weft yarn processing machine having a yarn processing unit, feed rollers disposed after the weft yarn processing unit, and yarn storage drums, comprises operating the feed rollers of the weft yarn processing machine at a constant speed, and operating the yarn storage drums in synchronism with the feed rollers at a winding speed slightly higher than the feed speed of the feed rollers.

When the feed rollers of the weft yarn processing machine are operated at a constant speed, the processing speed of the weft yarn processing machine is constant. The length of the weft yarn to be inserted in one weaving cycle is regulated by the yarn storage drum. Since the winding speeds of the yarn storage drums are slightly higher than the feed speeds of corresponding the feed rollers, an appropriate length of the weft yarn is wound surely on each yarn storage drum.

In FIG. 1, the rotary yarn storage drums 15 are driven through belts and pulleys by the motor M4. The controller 14 controls the motors M1 and M2 for driving back rollers 7a and 7b and the motor M3 for driving front rollers 8 for synchronous operation. The respective operating speeds of the back wollers 7a and 7b and the front rollers 8 are constant. The controller 14 controls the motor M4 so that the respective winding speeds of the yarn storage drums 15 are slightly higher (+3% to +5%) than the respective operating speeds of the corresponding front rollers 8. Accordingly, weft yarns are wound around the yarn storage drums 15 in a properly taut state, so that the weft yarns are delivered uniformly from the yarn storage drums 15. Since the respective operating speeds of the front rollers 8 and the yarn storage drums 15 are constant and the operating speeds are not varied according to the length of the weft yarn, the tension of the weft yarns is not subject to variation attributable to the difference in inertia between the front rollers 8 and the corresponding yarn storage drums 15.

FIG. 3 is a side elevation of a yarn storage drum 16 of a revolving yarn guide type. The yarn storage drum 16 has a flange 16a, a body 16b and a groove 16c and is held stationary by a magnet 16d. A revolving yarn guide 16e formed by bending a pipe and driven by the motor M4 revolves around the flange 16a to wind the weft yarn Y around the body 16b for storage. The weft yarn Y is held in the groove 16c with a plurality of holding pins 16f. The holding pins are operated by solenoid actuators 16g. The length of the weft yarn Y to be unwound from the body 16b for one weaving cycle is regulated by varying the number of solenoid actuators 16g actuated simultaneously. Therefore, the weaving speed of the loom need not be changed.

A control system for carrying out the method of operating the direct weaving apparatus when the direct weaving apparatus is provided with the rotary yarn storage drum will be described hereinafter with reference to FIG. 5. Referring to FIG. 5, there are shown a weft yarn processing machine controller 14, a loom controller 17, the yarn storage drum 15 and the gripper 44. Processing conditions including yarn speed are stored beforehand in the weft yarn processing machine controller 14. The loom controller 17 receives a start timing signal and a weaving speed signal through lines f1 and f2 from the weft yarn processing machine controller 14 and executes control operation on the basis of the received signals to determine a stopping angle. The loom controller 17 sends an emergency stop signal through a line f4 to the weft yarn processing machine controller 14. The weft yarn processing machine controller 14 provides a winding speed control signal on a line f5 to control the rotating speed of the yarn storage drum, provides a gripper control signal on a line f6 to control the gripper for on-off operation and provides a timing signal on a line f3 to control the length of the weft yarn to be delivered for one weaving cycle by timing the opening and closing operations of the gripper. The loom controller provides a timing signal on a line f7 to time the operation of the gripper so that the operation of the gripper is synchronous with the weaving operation. After the weft yarn processing machine controller 14 has been started by a starting signal given thereto through a line f8, the weft yarn processing machine including the front rollers and the yarn storage drums operates at a constant operating speed.

The method of operating the direct weaving apparatus, in accordance with the second embodiment of the present invention operates the feed rollers of the weft yarn processing machine at a constant operating speeds, operates the yarn storage drum at a winding speed slightly higher than the feed speed of the feed roller to wind the weft yarn satisfactorily on the yarn storage drum. Accordingly, the weft yarn processing machine is able to operate stably for continuous operation and a uniform weft can be fed to the loom.

Next, another embodiment of a weft yarn processing machine which provides an improved driving apparatus will be described.

Feed rollers in a weft yarn processing machine in this embodiment are constructed such that a plurality of feed rollers disposed across a processing box where a nonstretch textured yarn processing nozzle or the like is stored are combinations of driving rollers and pressing rollers which can be contacted to or separated from the driving rollers and the feed rollers are provided with a driving apparatus in which the pressing rollers for a plurality of feed rollers are opened or closed all at once.

According to this embodiment a plurality of feed rollers are opened or closed all at once under a mere operation of the driving device by an operator.

Figure 9:
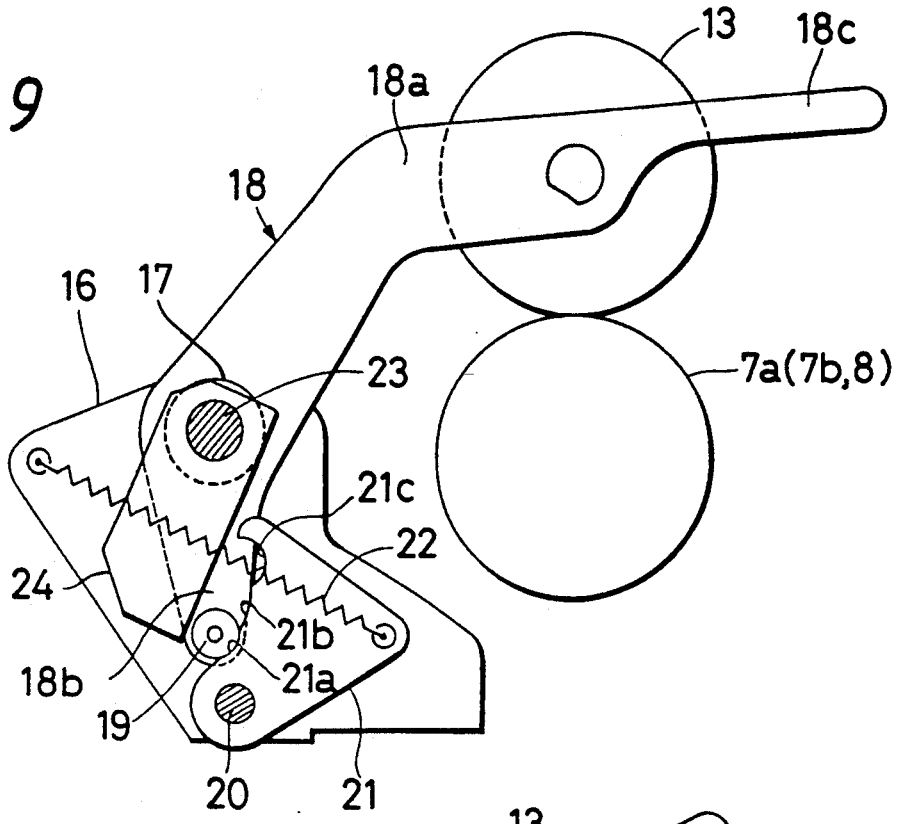
FIG. 9 is a side elevational view for showing a feed roller of a direct weaving apparatus.

FIG. 9 is a side elevational view for showing a feed roller of the embodiment. In FIG. 9 is illustrated a structure of one set of feed rollers and another feed roller also has a similar structure. An arm 18 is rotatably supported at a shaft 17 fixed to a bracket 16. A pressing roller 13 is rotatably supported at one arm 18a of the arm 18, and a cam follower 19 is fixed to the other arm 18b. Then, the bracket 16 is provided with a cam plate 21 which is oscillated around the shaft 20. The cam plate 21 has three cam grooves 21a, 21b and 21c for the cam follower 19 biased by a spring 22 in a counter-clockwise direction. As shown in the figure, in the case that the cam follower 19 is placed in the cam groove 21a, an appropriate pressing force is applied to the pressing roller 13 with a biasing force of the spring 22. To the rotating shaft 23 within the shaft 17 is a lever 24. As the lever 24 is rotated in a counter-clockwise direction, it may abut against the cam follower 19 to cause the cam follower 19 to be forcedly placed within the cam groove 21b.

Figure 10:
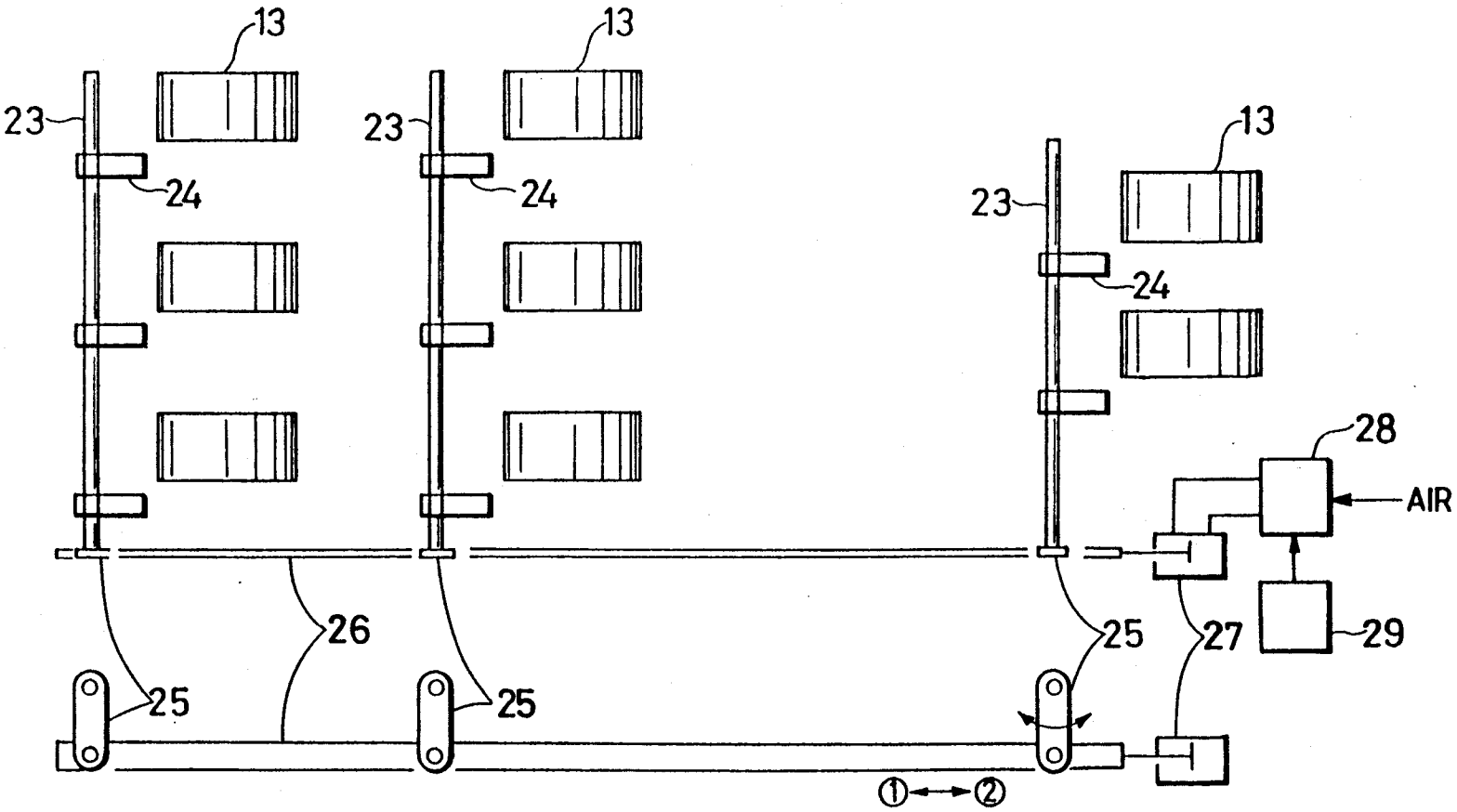
FIG. 10 shows a driving device for opening or closing the feed roller.

In FIG. 10, there are a total number of 8 in three rows (3+3+2 rollers) as the pressing rollers 13, and each of the pressing rollers is provided with a lever 24. A lever 25 is also fixed to one end of the rotating shaft 23 to which the levers 24 are fixed. The levers 25 are connected to one tie rod 26. To an end of the tie rod 26 is fixed a cylinder 27. The cylinder 27 is extended or retracted by a changing-over valve 28. The changing-over valve 28 is changed over by a push-button 29.

Figure 11:
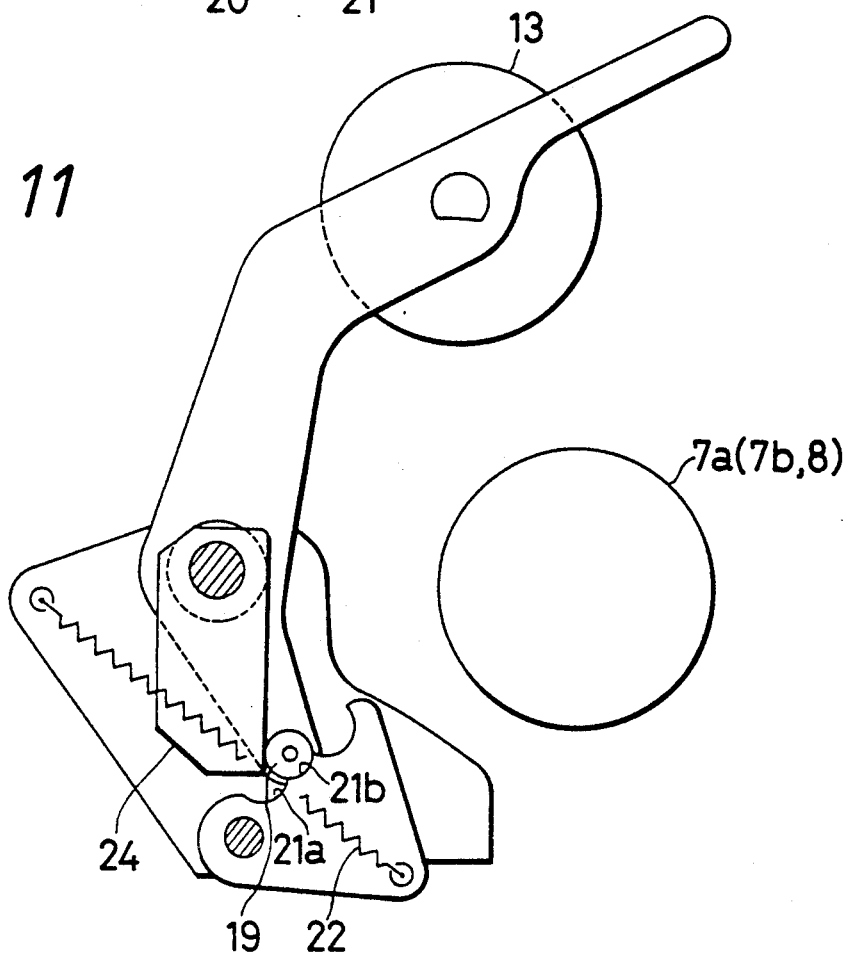
FIG. 11 is a side elevational view for showing a released state of the feed roller.

Operation of the aforesaid feed roller will be described later. In FIG. 10, the cylinder 27 is extended in a direction indicated by (1)) and the lever 24 is moved away from the cam follower 19 as shown in FIG. 9. The pressing roller 13 receives a biasing force of the spring 22 through the cam groove 21a and a proper pressing force is applied to it. In the event that a weft is drawn and fed when the weft yarn processing machine is energized again, the changing-over valve 28 is changed over by the push-button 29 in FIG. 10 and then the cylinder 27 is retracted in a direction indicated by ②. The lever 24 pushes the cam follower 19 as shown in FIG. 11 to cause the cam follower 19 to be placed in the cam groove 21*b* and then the pressing roller 13 is released. From this state, the changing-over vale 28 is changed over by the push button 29 shown in FIG. 10 and the cylinder 27 is extended in a direction of ①, resulting in that the lever 24 is rotated in a clockwise direction, moved away from the cam follower 19, the cam follower 19 is returned back into the cam groove 21*a* with the biasing force of the spring 24 and then the pressing roller 13 becomes its press contacted state shown in FIG. 9. In this way, all feed rollers are opened or closed under an operaticn of the push button 29, a burden of an operator is reduced as compared with the prior art in which each of the feed rollers is opened or closed, respectively, and there is no opportunity that the feed rollers are left open.

In FIG. 9, an extreme end 18*c* of the arm 18 is lifted up by hand and the cam follower 19 is placed within the cam groove 21*c*, resulting in that a biasing force of the spring 22 may act to hold the cam follower 19 to be held in the cam groove 21*c* and then its released condition is maintained. Then, the extreme end 18*c* of the arm 18 is pushed down by hand, the pressing roller is returned to its press contacted condition shown in FIG. 9.

In FIG. 1, reference numeral 15 denotes a rotary type storing drum, wherein this is driven by a common motor M4 through a belt and a pulley. Reference numeral 14 denotes a controller for the weft yarn processing machine which controls the number of revolution of each of the motors M1 to M4. In this controller 14 is assembled with a control device 22 shown in FIG. 1. In this way, if there are provided a system A and a system B, feed rollers under a combination of each of the back rollers, pressing rollers, front rollers and pressing rollers is disposed at each of four weft yarns Y1A to Y1B and then there are a total number of 8 pressing rollers. In this way, as the number of feed rollers which can be opened or closed is increased, their opening or closing operations become troublesome and a rate of occurrence of opportunity in which the feed rollers are left open is increased, so that it is preferable to use the feed rollers of the apparatus of this embodiment which an be opened or closed all at once.

The feed rollers in the weft yarn processing machine in this embodiment are constructed such that a plurality of feed rollers disposed across the processing box where a nonstretch textured yarn processing nozzles are stored are of a combination of driving rollers and press contacting rollers which can be opened or closed, there is provided a driving device in which the press contacting rollers for a plurality of feed rollers are opened or closed all at once, the plurality of feed rollers are opened or closed all at once under a mere operation of the driving device by an operator, so that the operation performed by the operator is reduced and it is possible to prevent an opportunity that the partial feed rollers are left open.

Figure 14A:
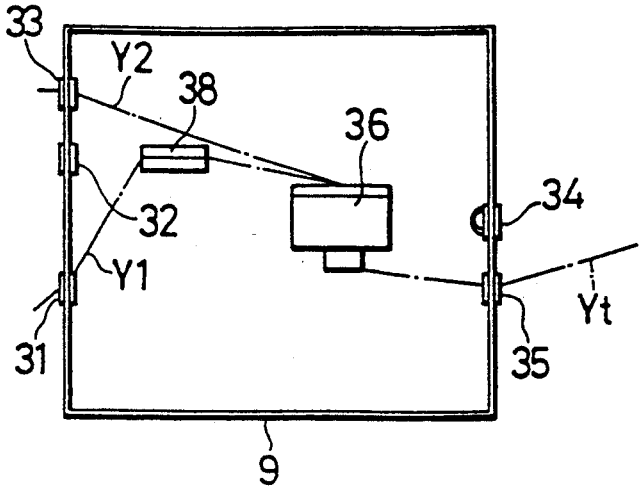
FIGS. 14*a*, 14*b* and 14*c* are views illustrating a yarn processing unit.
Figure 14B:
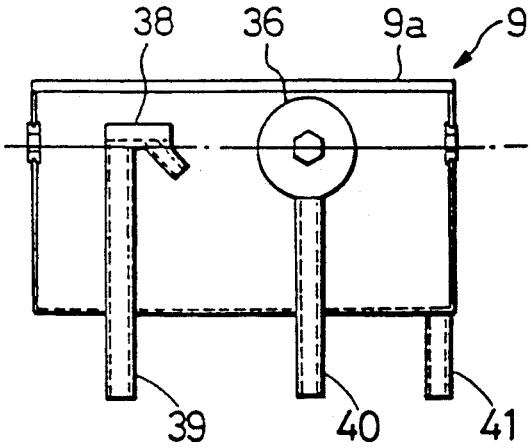
Figure 14C:
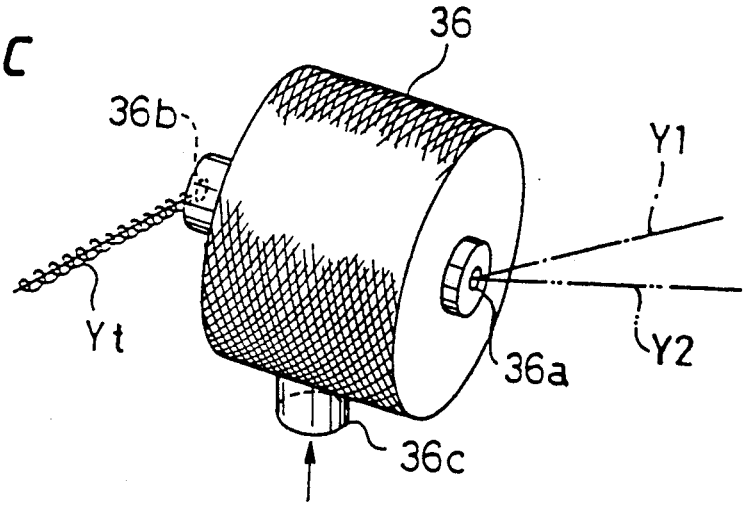

The processing unit will be described hereinafter with reference to FIGS. 14*a*, 14*b* and 15*c*. FIGS. 14*a* and 14*b* are a top plan view and a side elevation, respectively, of the processing unit 9. The processing unit 9 has a housing provided with a lid 9*a*, a nonstretch texturing nozzle 36 disposed on the center line of the housing with its axis perpendicular to the center line. A spraying nozzle 38 for spraying water to moisten the yarn Y1, which forms a core yarn, is disposed between a first yarn guide 31 and the nonstretch texturing nozzle 36. The yarn Y1 guided by the first yarn guide 31 so as to travel through the spraying nozzle 38, and the yarn Y2 guided by a third yarn guide 33 enter the nonstretch texturing nozzle 36 through a yarn inlet 36*a*. Compressed air is blown through an air inlet 36*c* into the nonstretch texturing nozzle 36 to twist the yarn Y2 around the other yarn Y1 to form a nonstretch textured yarn Yt. The nonstretch textured yarn Yt thus formed is delivered through a yarn outlet 36*b* from the nonstretch texturing nozzle 36 as shown in FIG. 14*c*. The nonstretch textured yarn Yt goes out of the processing unit 9 through a fifth yarn guide 35. As shown in FIG. 14*b*, a water supply pipe 39 for supplying water to the spraying nozzle 38, a compressed air supply pipe 40 to which the air inlet pipe 36*c* of the nonstretch texturing nozzle 36 is joined detachably, and a drain pipe 41 are fixed to the bottom wall of the housing of the processing unit 9. The processing unit 9 may be provided, if necessary, with an entangling nozzle for producing an entangled yarn instead of the nonstretch texturing nozzle 36. If the processing unit 9 is provided with an entangling nozzle, the yarns Y1 and Y2 are guided respectively by the first yarn guide 31 and a second yarn guide 32 to the entangling nozzle, and an entangled yarn is delivered through a fourth yarn guide 34 from the processing unit 9.

As aforementioned, the direct weaving apparatus comprising, in combination, the weft yarn processing machine and the loom is intended to deal with fabric production in a multiproduct, small-lot short-cycle production system. Since the weft yarn processing machine produces a single kind of weft yarn, the direct weaving apparatus is able to weave a fabric of a design using only the same kind of weft yarns. However, it is impossible to take full advantage of the direct combination of the weft processing machine and the loom if the direct weaving apparatus is capable of weaving only such a fabric of a simple design using a single kind of weft yarns. This embodiment of the present invention has been made on the basis of knowledge obtained through the study of the manner of application of the direct weaving apparatus to weaving fancy fabrics.

Accordingly, this embodiment of the present invention is intended to expand the field of application of the direct weaving apparatus and provides a direct weaving method capable of readily and optionally varying the longitudinal arrangement of colors and the like of the fabric during weaving operation. A direct weaving method of this embodiment, which uses, in combination, a weft yarn processing machine having a processing unit capable of processing a plurality of kinds of yarns and a loom provided with jet nozzles, comprises at least varying the processing conditions for the processing unit during weaving operation to introduce longitudinal variations in design including longitudinal color variations into the fabric.

When two yarns of different colors are fed to the processing unit at different overfeed ratios, respectively, the colors of the two yarns vary according to the overfeed ratios. The colors of the weft yarns are varied by changing the overfeed ratios during weaving operation to weave a fabric having colors varying lengthwise.

Figure 12:
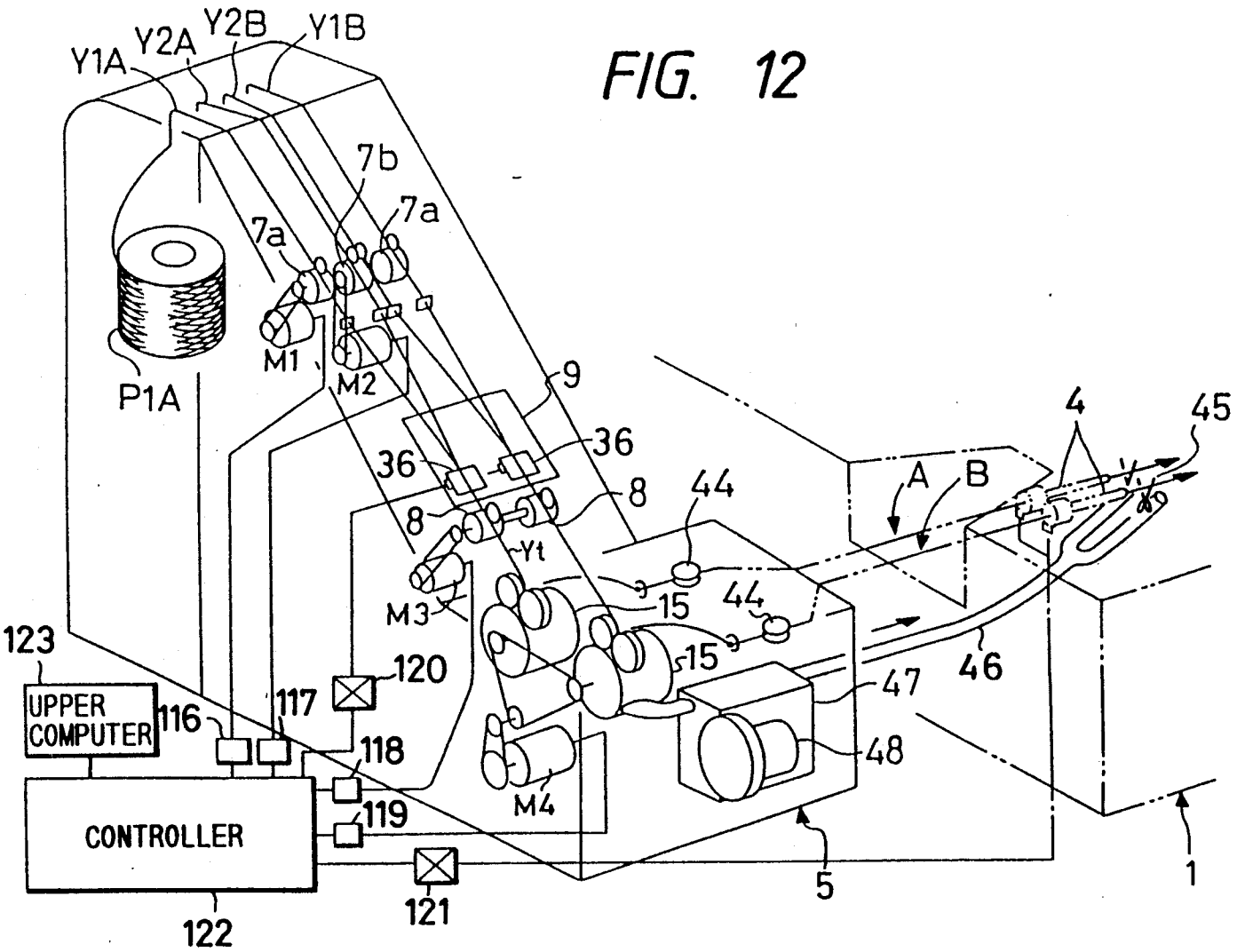
FIG. 12 is a perspective view of a direct weaving apparatus suitable for carrying out a direct weaving method in accordance with the present invention.

First, a direct weaving apparatus suitable for carrying out the direct weaving method of the present invention will be described with reference to FIG. 12, in which parts like or corresponding to those of the prior art direct weaving apparatus shown in FIGS. 6 and 8 are denoted by the same reference characters and the description thereof will be omitted. The direct weaving apparatus shown in FIG. 12 differs from that shown in FIGS. 6 and 8 in the employment of yarn storage drums instead of the yarn accumulating pipe. As shown in FIG. 12, the direct weaving apparatus has two jet nozzles 4. The direct weaving apparatus is provided with two yarn processing systems A and B, which process two yarns simultaneously to enhance weaving efficiency.

Referring to FIG. 12, motors Ml, M2, M3 and M4 respectively for driving back rollers 7*a*, a back roller 7*b*, front rollers 8 and a rotary yarn storage drum 15 are controlled through inverters 116, 117, 118 and 119, respectively, by a controller 122. The rotary yarn storage drums 15 are driven through belts and pulleys by the motor M4 and the operating speed of the motor M1 for driving the back rollers 7*a* is regulated by regulating the voltage applied thereto by an inverter 116. The ratios of the respective rotating speeds of the back rollers 7*a* and 7*b* to those of the corresponding front rollers 8 can individually be changed during weaving operation. Therefore, the overfeed ratio for a yarn Y1A fed to a nonstretch texturing nozzle 36 and that of a yarn Y2A can individually be changed during weaving operation.

The pressure of compressed air to be supplied to the nonstretch texturing nozzles 36 of the yarn processing unit 9 is set to a desired pressure during weaving operation by an electropneumatic proportional control valve 120 controlled by the controller 122. The pressure of compressed air to be supplied to the jet nozzles 4 can be set to a desired pressure during weaving operation by an electropneumatic valve 121 controlled by the controller 122.

A host computer 123 controls the controller 122 according to a predetermined control program to vary the respective overfeed ratios for the yarns Y1A, Y2A, Y2B and Y1B being fed to the nonstretch texturing nozzles 36, the winding speed ratios of the yarn storage drums 15 in winding nonstretch textured yarns Yt, such as Taslan yarns, the pressure of compressed air to be supplied to the jet nozzles 4 and the pressure of compressed air to be supplied to the nonstretch texturing nozzles 36 in predetermined controlled variable varying patterns. The controlled variable varying patterns are repeated periodically during weaving operation.

Figure 13A:
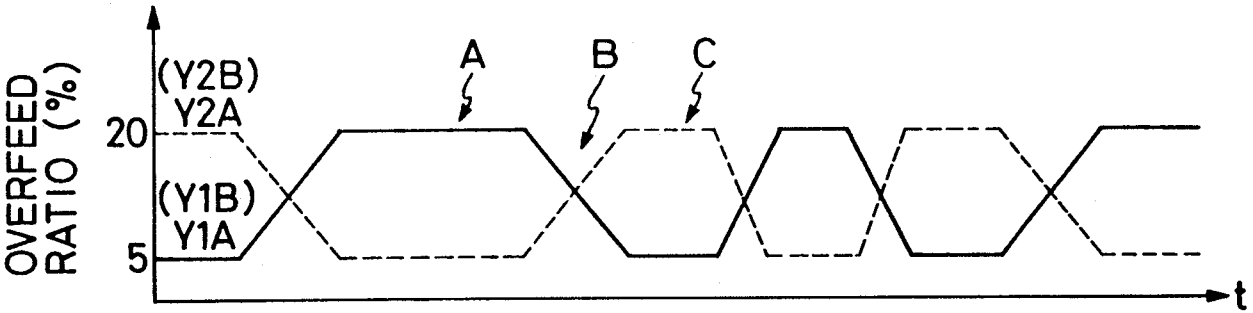
FIGS. 13*a*, 13*b* and 13*c* are diagrammatic views of assistance in explaining a mode of variation of processing conditions for a weft yarn processing machine and the effect of the same.
Figure 13B:
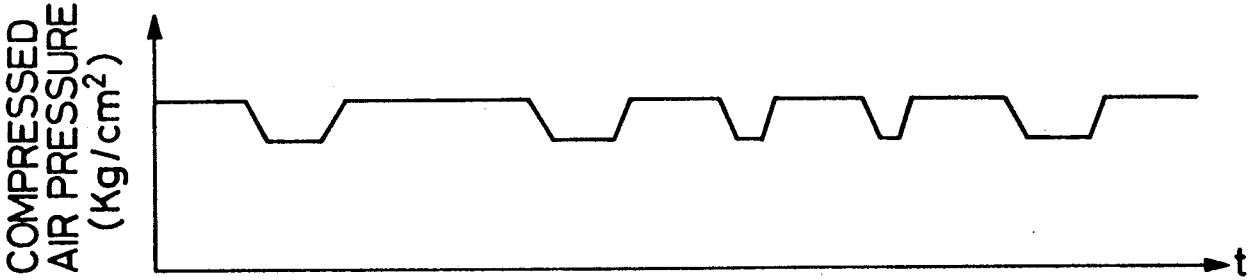
Figure 13C:
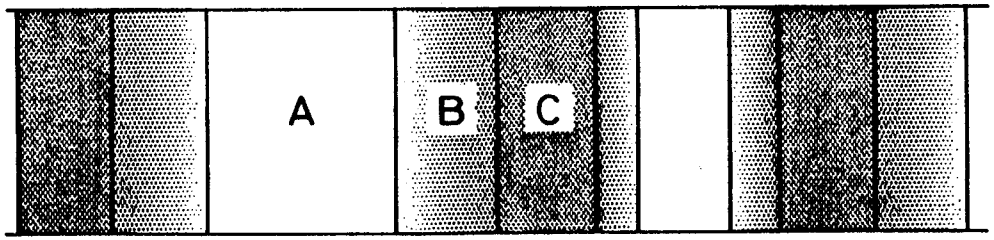

Exemplary controlled variable varying patterns stored in the host computer 123 will be described with reference to FIGS. 13*a*, 13*b* and 13*c*. The yarns Y1A (Y1B) was a yellow 75 denier spin-dyed polyester filament yarn, and the yarn Y2A (Y2B) was a blue 75 denier spin-dyed polyester filament yarns. As shown in FIG. 13*a*, the overfeed ratios respectively for the yarn Y1A (Y1B) and the yarn Y2A (Y2B) were varied periodically between 5% and 20% so that overfeed ratios vary inversely relative to each other, namely, the overfeed ratio for the yarn Y1A (Y1B) is 5% while the overfeed ratio for the yarn Y2A (Y2B) is 20%. As shown in FIG. 13*b*, the pressure of compressed air supplied to the nonstretch texturing nozzles 36 is reduced at times when the overfeed ratios respectively for the yarn Y1A (Y1B) and the yarn Y2A (Y2B) coincide with each other to make the elongation of the yarn Y1A (Y1B) and that of the yarn Y2A (Y2B) are equal to each other. When the processing conditions for the weft yarn processing machine are thus varied during weaving operation, the fabric has a section A of an yellow tint, a section B of a transient tint varying from yellow through green to blue, and a section C of a blue tint as shown in FIG. 13*c*. Thus, a fabric longitudinally varying in color can readily be woven. The width of the sections A, B and C can optionally be determined by operating keys of the host computer 23.

Preferably, the pressure of compressed air supplied to the jet nozzles are varied according to the processing conditions for the yarn processing machine to regulate the elongation of the nonstretch textured yarns Yt inserted into the fabric in addition to the variation of the overfeed ratios and the pressure of compressed air supplied to the nonstretch texturing nozzles. The winding speed ratios of the yarn storage drums may also be varied.

It is also possible to weave a fabric longitudinally varying in appearance, such as the distribution of crimps, by using yarns of the same color and of different types, such as differently crimped yarns of the same color. The direct weaving apparatus is able to process three or more weft yarns and to use entangling nozzles instead of the nonstretch texturing nozzles.

The direct weaving method of the present invention uses the direct weaving apparatus comprising, in combination, the yarn processing machine having the weft yarn processing unit for processing weft yarns, and feed rollers for feeding a plurality of yarns differing from each other in color or type individually to the weft yarn processing unit, and a loom provided with jet nozzles, and the direct weaving method varies at least the processing conditions for the weft yarn processing unit during weaving operation to introduce longitudinal variations in color or design. For example, the direct weaving method varies the colors of weft yarns by varying overfeed ratios for two yarns of different colors during weaving operation to weave a fabric having longitudinal sections differing from each other in color. Thus, the longitudinal design of the fabric can optionally and readily be changed without requiring complex dying processes and the like.

What is claimed is:

1. A method of operating a direct weaving apparatus, the apparatus including a loom and a weft yarn processing machine having a yarn storage drum, the weft yarn processing machine producing incompletely processed yarn during a start up period between a start of the weft yarn processing machine and a time when the weft yarn processing machine reaches a steady state, the method comprising the steps of:

starting the weft yarn processing machine, passing the incompletely processed weft yarn through the yarn storage drum to remove the incompletely processed weft yarn, winding the weft yarn on the yarn storage drum for storage in response to the weft yarn processing machine reaching the steady state, and starting the loom in response to a necessary length of the weft yarn being stored on the yarn storage drum.

2. A method of operating a weaving apparatus, the weaving apparatus including a loom and a weft yarn processing machine having a yarn processing unit, a yarn storage drum, and feed rollers disposed substantially between the yarn processing unit and the yarn storage drum, the method comprising the steps of:

rotating the feed rollers at a substantially constant speed;

feeding yarn from the feed rollers at a substantially constant yarn feed speed, the yarn feed speed corresponding to the speed of the feed rollers; and winding yarn from the feed rollers onto the yarn storage drum at a winding speed substantially greater than the yarn feed speed.

3. A method of operating a weaving apparatus, the weaving apparatus including a loom and a weft yarn processing machine having a yarn processing unit, a first feed roller for feeding a first yarn of a first color to the yarn processing unit and a second feed roller for feeding a second yarn of a second color to the yarn processing unit, the method comprising the steps of:

feeding the first yarn of a first color to the yarn processing unit at a first overfeed ratio;

feeding the second yarn of a second color to the yarn processing unit at a second overfeed ratio; and varying the first and second overfeed ratios during a weaving operation such that a fabric is produced having longitudinal color variations.

4. The method of claim 3, wherein the loom includes first and second jet nozzles, the method further comprising the steps of:

supplying pressurized air to the jet nozzles;

decreasing the pressure of the air as the first and second overfeed ratios approach one another; and increasing the pressure of the air as the first and second overfeed ratios diverge from one another.

5. The method of claim 3, wherein the step of varying the first and second overfeed ratios comprises the steps of:

substantially simultaneously increasing the first overfeed ratio and decreasing the second overfeed ratio during a first period; and substantially simultaneously decreasing the first overfeed ratio and increasing the second overfeed ratio during a second period.

* * * * *